US011187502B1

(12) United States Patent
Menefee, III et al.

(10) Patent No.: US 11,187,502 B1
(45) Date of Patent: Nov. 30, 2021

(54) METHODS AND DEVICES FOR CLEANING FIREARM BARRELS

(71) Applicants: James Y. Menefee, III, Macon, GA (US); Jason P. McDevitt, Williamsburg, VA (US)

(72) Inventors: James Y. Menefee, III, Macon, GA (US); Jason P. McDevitt, Williamsburg, VA (US)

( * ) Notice: Subject to any disclaimer, the term of this patent is extended or adjusted under 35 U.S.C. 154(b) by 0 days.

(21) Appl. No.: 17/235,048

(22) Filed: Apr. 20, 2021

(51) Int. Cl.
*F42B 5/24* (2006.01)
*F42B 7/08* (2006.01)
*F42B 7/04* (2006.01)

(52) U.S. Cl.
CPC ..... *F42B 5/24* (2013.01); *F42B 7/046* (2013.01); *F42B 7/08* (2013.01)

(58) Field of Classification Search
CPC .... F42B 7/08; F42B 7/10; F42B 7/046; F42B 5/24
USPC ..... 102/442, 529
See application file for complete search history.

(56) References Cited

U.S. PATENT DOCUMENTS

| | | | | |
|---|---|---|---|---|
| 1,231,227 | A | 6/1917 | Williams | |
| 3,740,883 | A | 6/1973 | Kyle | |
| 3,952,662 | A * | 4/1976 | Greenlees | F42B 12/34 102/400 |
| 6,202,562 | B1 * | 3/2001 | Brunn | F42B 12/34 102/293 |
| 7,814,820 | B2 | 10/2010 | Menefee | |
| 8,276,519 | B2 | 10/2012 | Menefee | |
| 9,052,172 | B2 | 6/2015 | Whitworth | |
| 9,182,202 | B2 | 11/2015 | Menefee | |
| 10,018,455 | B2 * | 7/2018 | Whitworth | F42B 5/24 |
| 10,302,385 | B2 | 5/2019 | Whitworth | |
| 2007/0135218 | A1 * | 6/2007 | Williams | F41J 7/04 463/49 |
| 2011/0017090 | A1 * | 1/2011 | Menefee, III | F42B 7/02 102/448 |
| 2013/0055916 | A1 * | 3/2013 | Menefee, III | F42B 7/08 102/334 |
| 2013/0055917 | A1 * | 3/2013 | Menefee, III | F42B 7/04 102/334 |
| 2013/0228090 | A1 * | 9/2013 | Billings | F42B 7/08 102/457 |
| 2018/0274889 | A1 * | 9/2018 | Havens | F42B 7/08 |

FOREIGN PATENT DOCUMENTS

| | | | | |
|---|---|---|---|---|
| WO | WO-0002004 | A2 * | 1/2000 | F42B 12/367 |

* cited by examiner

*Primary Examiner* — John Cooper
(74) *Attorney, Agent, or Firm* — Jason P. McDevitt

(57) ABSTRACT

Herein we describe barrel-cleaning cartridges which can be loaded into a firearm and then fired to perform the task of cleaning the barrel of said firearm. The barrel-cleaning cartridges include a propellant, a flexible textile that assumes a general cup shape within the cartridge, and a particulate obturating media, some of which is encircled by the flexible textile. These components combine to form a good gas seal and to clean the barrel of a firearm, including elements of the barrel having variations in diameter. The obturating media comprises particles having an average particle size greater than 212 microns, and an average specific gravity greater than 1.1, and a hardness of less than 7 on the Mohs scale.

19 Claims, 9 Drawing Sheets

METHODS AND DEVICES FOR CLEANING FIREARM BARRELS

CROSS-REFERENCE TO RELATED APPLICATIONS

Not applicable

STATEMENT REGARDING FEDERALLY SPONSORED RESEARCH OR DEVELOPMENT

Not applicable

BACKGROUND

Field of the Invention

The field of the invention relates to cartridges for use in cleaning the interior of gun barrels.

Description of the Related Art

When a firearm is used, the interior of its barrel can accumulate dirt. It can rust or corrode if it is not cleaned, and it is preferable to remove the contaminants shortly after use of the firearm. Unfortunately, the cleaning process can take a significant amount of time, and it is often inconvenient to do so right after use. There is a long-felt need for a quick, convenient method for cleaning the barrel of a firearm.

This need is well-documented over more than a century of patents claiming methods for shooting a specially designed cartridge to clean the bore of a firearm, many of which used compressed wadding that travels down the barrel at high speed to perform the cleaning. A 1917 patent to Lisle Williams (U.S. Pat. No. 1,231,227) describes a cartridge for cleaning the barrel of a rifle designed to be shot through the barrel, wherein an expanding fabric in the cartridge cleans the barrel using friction. In U.S. Pat. No. 2,047,897, Symes describes a barrel-cleaning cartridge that incorporates a lubricated cleaning wad. In U.S. Pat. No. 3,209,690, Mercatoris describes a barrel-cleaning cartridge with a cleaning wad and a liquid that is released upon firing. In U.S. Pat. No. 9,052,172, Whitworth points out deficiencies in the prior art and describes a cartridge that cleans the bore upon firing, which includes a collapsing feature that breaks a frangible capsule containing a cleaning agent. In U.S. Pat. No. 10,302,385, Whitworth describes a cartridge that cleans a bore upon firing which contains a bore rearward disk, a fibrous cup, and a bore forward disk. The commercial product CLEAN-SHOT® (available from Huntego Limited) is a cartridge containing various elements configured to clean the bore of a firearm and it performs that task well. Unfortunately, it requires expensive components, is costly to load, and generates plastic waste.

Menefee describes wad-less cartridges, and methods for their manufacture, in U.S. Pat. Nos. 8,276,519 and 7,814,820. In U.S. Pat. No. 8,276,519, Menefee describes a suitable obturating media as one in with no "lower limit of suitable particle sizes that work", and an "approximate upper limit of useful particle sizes of 0.005 inch to about 0.008 inch for particles that function with a good obturating effect". Accordingly, Menefee describes an approximate upper limit of good obturating effectiveness of 203 microns.

There is a need among users of firearms for a convenient, time-efficient, and inexpensive device for cleaning a barrel of moisture, powder residue, plastic, metals, and/or foreign material, with the advantage of reducing the frequency and/or time urgency of a more comprehensive manual cleaning.

SUMMARY

The present disclosure provides an improved method and device for cleaning the interior barrel of a firearm. A barrel-cleaning cartridge is provided which includes a primer, a propellant, a flexible textile that forms a cup inside the cartridge, an optional contiguous solid wad, and particulate obturating media that is partially contained within the flexible textile and also directly contacts the side walls of the cartridge. In typical embodiments, the obturating media comprises particles having an average specific gravity greater than 1.1, with average hardness less than 7 on the Mohs scale, and with average size of greater than 212 microns. In preferred embodiments, the barrel-cleaning cartridge does not contain typical projectiles such as slugs or metal shot of sufficient density or size to cause serious injury to a subject with eyes closed at a distance of greater than 20 feet. In preferred embodiments, the particulate obturating media comprises particles that are useful as blast media for cleaning surfaces without also aggressively damaging or etching surfaces. In order to clean the barrel of a firearm, a person simply loads the barrel-cleaning cartridge into a firearm like a typical cartridge and fires the firearm.

Upon firing, components of the cartridge accelerate down the barrel, and typically exit the barrel at speeds of between 400 feet per second (f/s) and 3,000 f/s. High speeds of the ejecta are common with these loads since the weight of the ejecta is low. The particulate obturating media provides gas sealing and sufficient weight (typically at least ¼ ounce of obturating media) to ensure clean burning of the propellant powder. When utilized, a solid wad provides some gas sealing and also provides protection for the textile to reduce ripping of the textile. The textile is pressed outwards against the barrel at high pressure by particulate obturating media, allowing it to remove contaminants. Moreover, the textile reduces the frictional force against the walls of the cartridge when the cartridge is fired relative to obturating media alone, reducing the likelihood that the cartridge walls will tear, which can occur easily when the volume occupied by the textile is replaced with additional particulate obturating media.

Barrel contaminants are also loosened and removed by the particulate obturating media. In the loaded cartridge, at least one or more types of particulate obturating media directly contact the side walls of the cartridge, rather than simply being contained or encircled within the textile or other components. Thus, when the cartridge is fired, some portion of the particulate obturating media will directly contact the barrel of the firearm, rather than being limited to pressing out against a textile that contacts the barrel. The textile component of the barrel-cleaning cartridge does not extend the complete length of the hull, but instead extends only part of the way. The particulate obturating media occupies a length within the hull of at least 8 mm, typically more than 8 mm.

The textile has a basis weight greater than or equal to 4 ounces per square yard ("osy"), and less than or equal to 30 osy, and preferably is made from biodegradable materials such as cotton, linen, jute, hemp, burlap, rayon, other cellulosic materials, wool, or silk. The textile assumes the general shape of a cup inside the cartridge, although the textile cup walls do not extend all the way to the top of the cartridge. When the cartridge is fired, the textile is pushed not only through the barrel, but also outwards against the barrel, thereby rubbing with substantial force against the barrel to remove contaminants.

The textile can be woven, knitted, or nonwoven. It is crucial that the textile is flexible, such that the outward pressure from the particulate obturating media (and optional solid wad) inside of the generally cup-shaped textile is transmitted through the textile against the barrel of the gun. It is important that in at least some horizontal cross-sectional slices of the cartridge, obturating media is entirely contained within a roughly circular border provided by the textile. This encircling containment allows the obturating media, upon firing of the cartridge, to exert an outward force against the flexible textile. The vertical length of the textile within the cartridge must be at least 6 mm, or at least 8 mm, or at least 10 mm, when measured from at least one point along the 360 degree hull. The flexible textile assumes a general cup shape within the cartridge, but its vertical length will typically not be identical around all 360 degrees of the cartridge. Some portions are likely to extend further along the hull than others.

When a barrel cleaning cartridge is fired, textiles with a basis weight of less than 4 osy (e.g., 2 osy) are more likely to rip without fully providing the desired surface cleaning provided by the textile, thereby reducing overall cleaning performance. Textiles with a basis weight greater than 30 osy (e.g., 32 osy) take up a substantial amount of room within the cartridge, making it more difficult to provide sufficient weight within the cartridge to ensure complete powder burn without adding metals, and also making it more difficult to fold the fabric around a wad and insert it into the primed hull. Accordingly, the textile should be between about 4 osy and 30 osy.

In some embodiments, the textile has some elasticity, which can reduce ripping of the textile when the cartridge is fired. Upon firing, portions of the textile are simultaneously pressed with great force in opposing directions.

The optional solid wad that can be used to protect the textile can be any suitable wad provided it is no longer than one inch in length. When utilized, the solid wad can be inserted into the cartridge during loading either before or after the textile. Typically, in the former case, the solid wad is directly loaded on top of the propellant powder, after which the textile would be loaded. In the latter case, the solid wad would typically be loaded inside of the textile, which would form a flexible cup inside the cartridge, with the wad inside of the textile. In such embodiments wherein the wad is placed inside of a flexible textile cup, the wad must be undersized for the hull, i.e., at least 0.020 inches in diameter undersized, in order to accommodate the textile that is wrapped around the wad. In preferred embodiments, the wad is made using non-plastic materials including but not limited to wool felt, nitro cards, fiber, and cork.

While the particulate obturating media and textile scour the bore at high pressure, the last component of the cartridge that exits the bore is the propellant powder. Accordingly, it is crucial to obtain a clean powder burn, which requires resistance against the rapidly expanding gas. Single-base powders can be particularly effective.

Suitable particulate obturating media can include any type of particles, although some are better suited than others. In particular, particles comprising organic polymers, inorganic compounds, and/or combinations thereof can perform well as obturating media in accordance with the methods and devices described herein. Biodegradable plastics can be used in accordance with the methods and devices described herein. Other organic polymers can also be utilized. For example, naturally occurring organic obturating media comprising a combination of three different types of organic polymers (cellulose, hemicellulose, and lignin) can be quite effective. For example, granulated corn cobs and granulated nut shells can make very good obturating media for shotshells. Obturating media comprising inorganic particles, or particles containing substantially inorganic compounds, can also be quite effective in providing good performance. Suitable such obturating media include glass beads or crushed glass, aluminum oxide, crushed seashells (e.g., oyster), and eggshells. To the extent metals are used, the metallic media must be soft (Mohs scale less than 7, preferably less than 5 for metallic media) and small (less than 1000 microns in average diameter), such that the particles generally do not damage the barrel surface.

It is important that the obturating media not scratch the barrel of a shotgun, and thus particle compositions having hardness equal to or greater than 7 on the Mohs scale (including many inorganic particle media) are disfavored for most gun barrels. Hard, dense materials are unsuitable, such as steel shot or tungsten shot. Other potentially lethal projectiles, including other shot materials such as bismuth and lead, are also disfavored. As the density of particulate obturating media increases, it is important to reduce particle size.

One significant advantage of the methods and cartridges designed herein is their ability to clean all parts of a gun barrel. Gun barrels are not always uniformly sized, even when nominally the same size. Moreover, there are variations within a given barrel. For example, the forcing cone tapers down to the diameter of the bore, and the bore can be larger than an attached choke. The obturating media expands to fill the space, as does the textile. In contrast, solid wads and other cleaning devices of fixed diameter used in the prior art have little ability to significantly expand.

BRIEF DESCRIPTION OF THE DRAWINGS

The summary above, and the following detailed description, will be better understood in view of the drawings which depict details of preferred embodiments.

DETAILED DESCRIPTION

Figure 1:
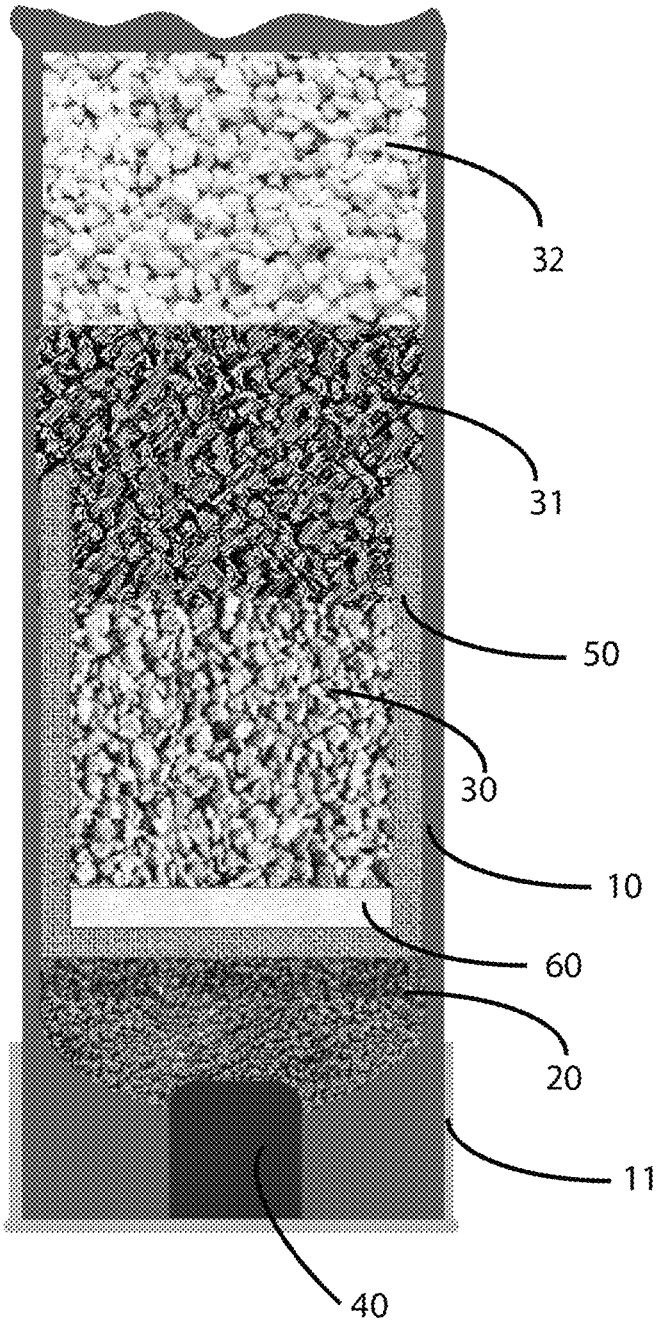
FIG. 1 shows a cutaway perspective view of one embodiment of a barrel-cleaning shotgun shell loaded with multiple types of particulate obturating media as described herein.

The present disclosure is directed to cartridges useful for cleaning the interior barrel of a firearm, methods for their manufacture and loading, and methods for their use. A cartridge is provided which includes a primer, a propellant, a flexible textile, and one or more types of particulate obturating media. The obturating media is comprised of particles, wherein the particles have an average specific gravity exceeding 1.1, and wherein the obturating media is loaded in an amount sufficient to fill 8 mm or more along the length of the cartridge, typically 10 mm or more, in order to produce upon firing of the cartridge a satisfactory force exerted by the obturating media against both the flexible textile and the barrel. The flexible textile forms a general cup shape such that horizontal cross-sections of the cartridge reveal obturating media encircled within the cartridge by the flexible textile. The flexible textile extends at least 6 mm along the length of the cartridge, preferably at least 8 mm, and typically more than 8 mm.

The term "wad" refers to a pre-formed component of a shotgun shell that is used to separate the shot from the powder, and/or to provide a seal that allows pressure to build and then prevents gas from blowing through the shot rather than propelling the shot out of the shotgun, and/or contain the shotgun shot, and/or provide cushioning, and/or fill space in the shell.

As the context allows, the term "cartridge" can refer to the finished manufactured article, such as a completed ammunition cartridge; however, in some contexts, the term "cartridge" may refer to the empty "casing" or "case" or "hull" that is charged according to this disclosure to provide the finished article, as apparent from its particular use.

The particles used in the particulate obturating media are rarely spherical and rarely possessive of a single diameter. Instead, they are typically irregularly shaped. As used herein, the term "size" of a particle refers to the largest sieve filter on which a particle is retained. For example, a particle having a size of 250 microns is a particle that is typically retained on a 60 mesh filter (U.S. mesh size, where the mesh size is the number of threads per square inch in each direction) having square grid hole sizes of 250 μm, which would also be retained on smaller mesh grids (i.e., higher mesh numbers), but passes through larger mesh grids such as a 50 mesh filter having openings of 297 μm. Not all particles in an obturating medium will have the same size. Typically a range of sizes is utilized. For example, a 12/20 walnut media refers to an obturating media in which most of the particles pass through a number 12 mesh screen (1680 μm), and most of the particles are retained on a 20 mesh screen (841 μm). Similarly, a 20/30 corn cob media means that most particles pass through a 20 mesh screen, but are retained on a 30 mesh screen.

As used herein to refer to particles sizes in a particulate obturating media, the term "average" refers to the size of the opening in a mesh filter that retains half of the mass of an obturating media. For example, an obturating media having an average size of 1,000 μm would pass half of its mass through a number 18 mesh screen (1000 micron screen), while the other half of the mass would be retained on the screen.

As used herein, the term "textile" means a flexible material made by an interlocking network of yarns and/or fibers. The textile can be woven, knitted, or nonwoven. As defined herein, there are no fabric density limits to nonwovens. For example, as defined herein, felt is a nonwoven material (perhaps the original man-made nonwoven material). As defined herein and also in accordance with the definition of the Association of the Nonwoven Fabrics Industry (IVDA), a nonwoven textile requires that over 50 percent of its weight must be fibers with a length-to-diameter ratio of at least 300. This eliminates paper, which is made of very short fibers. From a visual perspective, a textile typically has fibers or yarn that can be independently seen with the naked eye.

It is crucial that the textile is flexible, such that outward pressure from the particulate obturating media inside of the generally cup-shaped textile is transmitted through the textile fabric against the barrel of the gun. If the cup-shaped textile is too stiff, then it would do a far worse job of scrubbing residue from the barrel, as there would be fewer points of contact, and reduced scrubbing force. As a counter-example, consider a hard plastic tube, which, irrespective of outward-pressing forces, would be ineffective at simultaneously expanding outward to scrub barrel walls around its entire 360 degree perimeter.

While a shotshell cartridge can be properly loaded with propellant and particulate obturating media to produce a barrel-cleaning load, when such a cartridge is fired, the barrel itself does not emerge clean, even though the particulate obturating media presses outwards to scour the barrel. The result is that the barrel is cleaned or partially cleaned of some contaminants (e.g., plastic and lead residues) by the particulate obturating media, but the particulate obturating media may not clean everything and moreover, the media itself will also tend to leave behind very small particles (created by the particulate obturating media breaking apart at very high pressures) that can appear as a surface film or dust. The barrel of the firearm may be cleaner after use of such a cartridge, but to many gun owners, it would not be sufficiently clean. By combining the action of the particulate obturating media with a flexible textile that is pressed with great force against the barrel, as described herein, one obtains greatly improved cleaning performance. Moreover, inclusion of the flexible textile reduces the likelihood of tearing the hull, which can happen when substantial amounts of obturating media are utilized in a cartridge and fired at high pressure.

As used herein, the term "flexible" as it refers to a textile, or "flexible textile", means a textile that when subjected to the cantilever test option of ASTM D-1388 (a standard test method for stiffness of fabrics), has an average overhang length of six inches, or 5 inches or less, or 4 inches or less, or 3 inches or less.

The cantilever test uses the principle of cantilever bending. A rectangular specimen (25 mm×200 mm) of the textile is supported on a smooth, low-friction, horizontal platform.

A weighted slide is placed over the specimen and advanced at a constant rate. As the leading edge of the specimen projects from the platform, it bends under its own weight, and ultimately as it continues to move forward the specimen will contact an angled surface that is set at 41.5° below the plane of the platform surface. At this point, the test is stopped, and the length of the overhanging fabric is measured. Stiffer materials will have longer overhanging lengths.

As used in barrel-cleaning loads described herein, the textile has a basis weight greater than or equal to 4 ounces per square yard ("osy"), and less than or equal to 30 osy, and preferably is made from biodegradable materials such as cotton, linen, jute, hemp, burlap, rayon, other cellulosic materials, wool, or silk. The textile assumes the general shape of a cup inside the cartridge, although the cup walls of the flexible textile do not extend all the way to the top of the cartridge. In typical embodiments, the flexible textile extends at least 8 mm, or 10 mm, or more, from its most proximal point within the cartridge to its most distal point within the cartridge along the same section of the cartridge wall.

When the cartridge is fired, the textile is compressed and then pushed out of the barrel, but is also pushed outwards against the barrel by particulate obturating media (and optionally a solid wad) contained within the cup portion of the textile, thereby rubbing with substantial force against the barrel to remove contaminants.

FIG. 1 is a schematic cutaway diagram showing a shotgun shell according to one embodiment of the disclosure as described herein. The cartridge case 10 (cutaway in the diagram to reveal the contents inside the casing), here shown to include a brass or metal-plated head 11 and primer 40, contains a powder charge or propellant 20 adjacent to a flexible textile 50, which is wrapped around a contiguous wad 60, which could be a nitro card, a fiber wad, or any other solid wad that provides sufficient backing such that the flexible textile is less likely to rip apart upon firing. The flexible textile 50 is roughly cup-shaped within the cartridge, and contains a particulate obturating media 30. In this representative embodiment, the textile cup 50 does not extend to the top, crimped end of the hull. In other embodiments, the textile cup 50 could extend a lesser length or a greater length towards the crimp. In this embodiment, a second particulate obturating media 31 is partially contained within the textile cup, and extends beyond the top of the textile cup. In this representative embodiment, a third particulate obturating media 32 is also loaded into the cartridge on top of particulate obturating media 31. In other embodiments, as few as one type of particulate obturating media could be used, or more than three different particulate obturating media can be used. A base wad of the types known in the art can be present as well, or can be built into the hull. The cartridge case would typically be crimped using any type of crimp known in the art.

After the barrel-cleaning cartridge is loaded into a firearm, upon firing, the primer 40 ignites the powder charge 20, which propels the ejecta (including the textile cup 50, the solid wad 60, and particulate obturating media 30, 31, and 32) downfield. The textile cup in combination with the solid wad forms a gas seal upon firing. This seal is supplemented by the particulate obturating media, which flows to press outwards against the textile cup 50, or simply outwards against the barrel, to help seal gaps through which propellant gases could otherwise escape. In this embodiment, upon firing, particulate obturating media 32 moves downfield but also presses outwards against the interior elements of the barrel, followed by particulate obturating media 31, followed by the flexible textile 50, all of which can assist in loosening and removing dirt, debris, rust, leading, plastic, and powder residue from the interior of the barrel.

Figure 2:
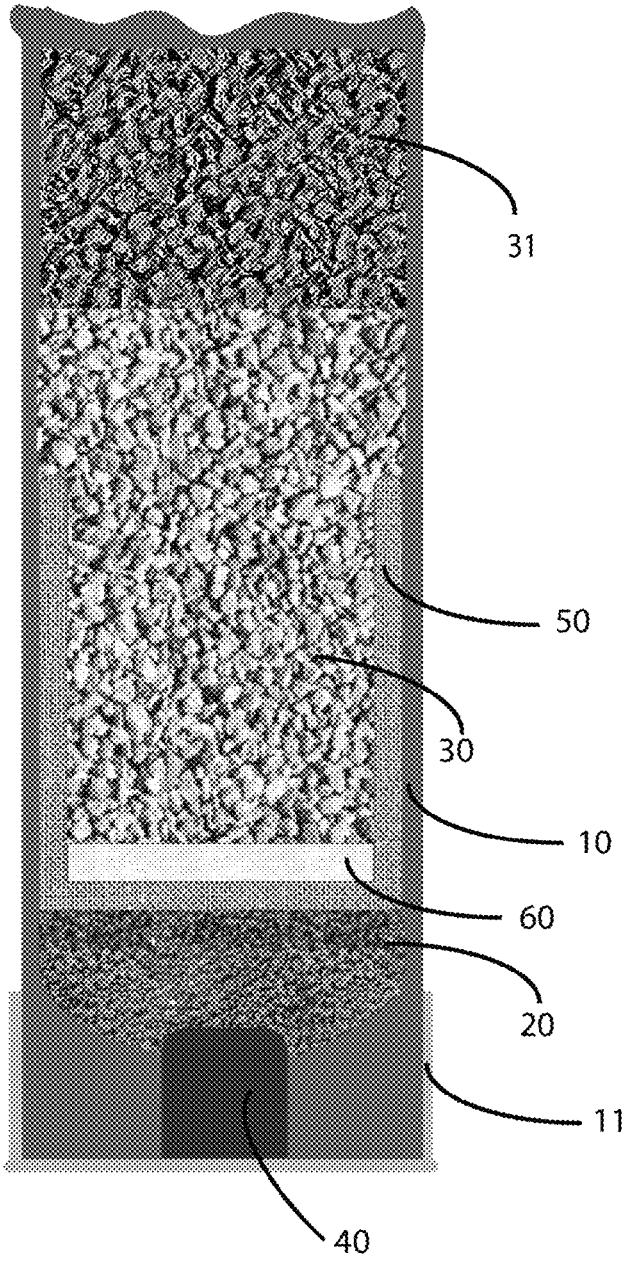
FIG. 2 shows a cutaway perspective view of one embodiment of a barrel-cleaning shotgun shell loaded with two types of particulate obturating media as described herein, wherein a flexible textile cup does not entirely contain the first layer of particulate obturating media.

FIG. 2 is a schematic cutaway diagram showing a shotgun shell according to one embodiment of the disclosure as described herein. The cartridge case 10 (cutaway in the diagram to reveal the contents inside the casing), here shown to include a brass or metal-plated head 11 and primer 40, contains a powder charge or propellant 20 adjacent to a flexible textile 50, which is wrapped around a solid wad 60. The flexible textile 50 is roughly cup-shaped within the cartridge, and partially contains a particulate obturating media 30. The particulate obturating media 30 extends beyond the top of the textile cup 50. In this embodiment, a second particulate obturating media 31 is loaded into the cartridge on top of particulate obturating media 30.

In one aspect, a hull is inserted into a cup-shaped metal head (typically made from brass or plated metal) by any means known in the art for making ammunition to provide a cartridge. The primer 40 provides the explosive charge to the cartridge 10. In order to load the cartridge, a selectively measured amount of appropriate propellant 20 is poured into the open end of the cartridge 10. The measured amount of propellant 20 may vary depending on the type of cartridge 10 that is being loaded. For example, the selected amount of propellant 20 for loading a 12-gauge shotgun hull is larger in volume, and can have different types of burning characteristics, than is required for loading a 0.410-gauge shotgun hull. A flexible textile 50 is inserted into the hull such that it is wrapped around solid wad 60. For example, during loading, the flexible textile can be centered on top of the open end of cartridge 10, and solid wad 60 positioned on top of the flexible textile and pushed into the cartridge along with the flexible textile, thereby forming the textile cup wrapped around the solid wad. A selectively measured amount of particulate obturating media 30 is poured into the open end of cartridge 10 and into the textile cup 50 on top of solid wad 60. Subsequently, additional particulate obturating media 31 is introduced into the open end of the cartridge 10 over the particulate obturating medium 30. During loading, a packing tool, including but not limited to a metal rod, can be used to press air out of the particles in the cartridge. In some embodiments, the particulate obturating medium is loaded in stages along with packing to avoid overflow or spilling. During the loading process, the open end of the casing is crimped with a roll crimp, star crimp, or any other crimping style known in the art. Typically a six-point or eight-point seal is used. Crimping is used to contain the load within the confines of the shell, assist the powder burn to create adequate combustion pressure during the early stages by reducing premature movement, provide predictable release of the ejecta as pressure builds, and protect the contents of the cartridge from contamination. In some embodiments, a sealant such as a glue or wax (not shown in FIG. 2) is added to seal the crimp.

Figure 3:
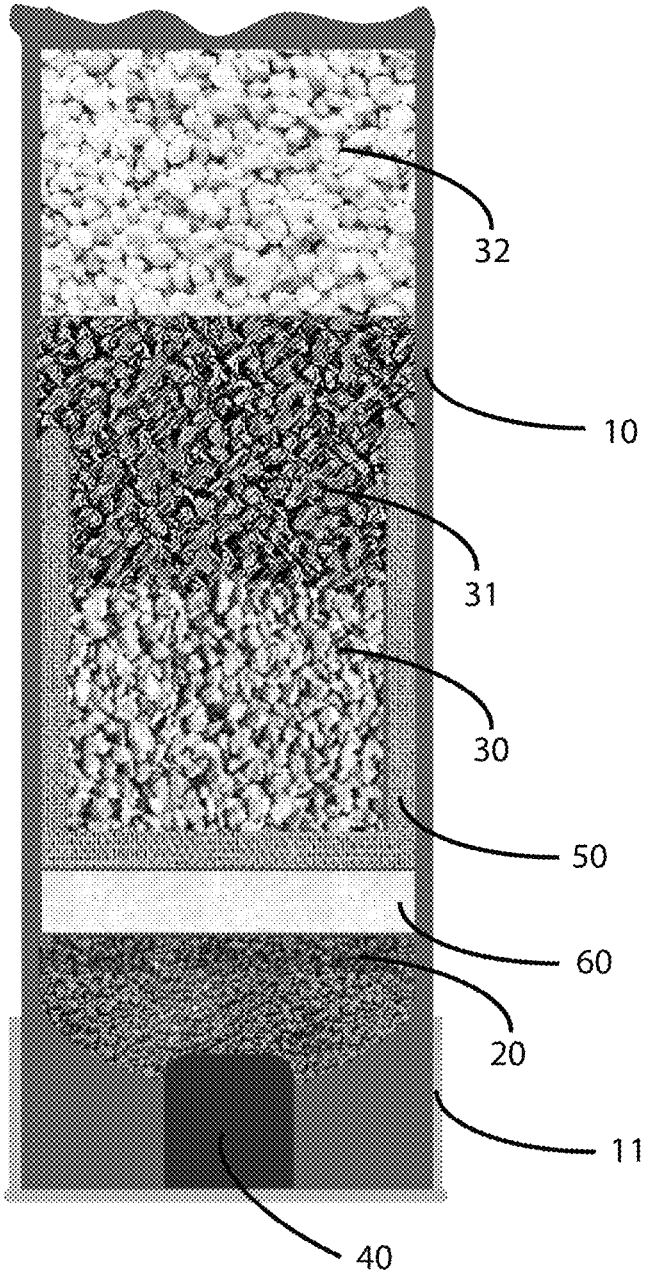
FIG. 3 shows a cutaway perspective view of one embodiment of a barrel-cleaning shotgun shell loaded with multiple types of particulate obturating media as described herein. In this embodiment, the solid wad is between the propellant powder and the flexible textile.

FIG. 3 is a schematic cutaway diagram showing a shotgun shell according to one embodiment of the disclosure as described herein. The cartridge case 10 (cutaway in the diagram to reveal the contents inside the casing), here shown to include a brass or metal-plated head 11 and primer 40, contains a powder charge or propellant 20 adjacent to a solid wad 60, on top of which is a flexible textile 50. The flexible textile 50 is roughly cup-shaped within the cartridge, and contains a particulate obturating media 30. In this representative embodiment, the textile cup 50 does not extend to the top, crimped end of the hull. In other embodiments, the textile cup 50 could extend a lesser length or a greater length towards the crimp. In this embodiment, a second particulate obturating media 31 is partially contained within the textile cup, and extends beyond the top of the textile cup. In this representative embodiment, a third particulate obturating media 32 is also loaded into the cartridge on top of particulate obturating media 31. In other embodiments, as few as one type of particulate obturating media could be used, or more than three different particulate obturating media can be used. A base wad of the types known in the art can be present as well, or can be built into the hull. The cartridge case would typically be crimped using any type of crimp known in the art.

Figure 4:
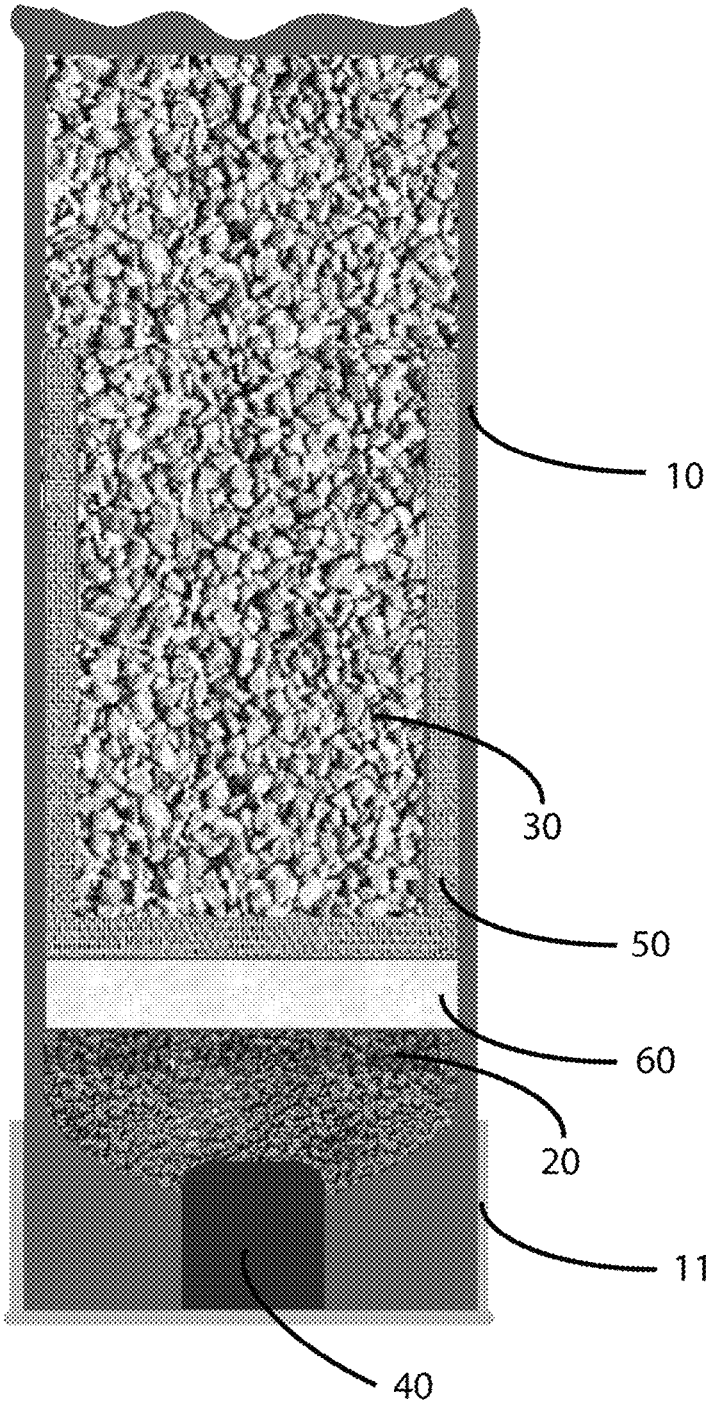
FIG. 4 shows a cutaway perspective view of one embodiment of a barrel-cleaning shotgun shell loaded with a single type of particulate obturating media as described herein.

FIG. 4 is a schematic cutaway diagram showing a shotgun shell according to one embodiment of the disclosure as described herein. The cartridge case 10 (cutaway in the diagram to reveal the contents inside the casing), here shown to include a brass or metal-plated head 11 and primer 40, contains a powder charge or propellant 20 adjacent to a solid wad 60, on top of which is a flexible textile 50. The flexible textile 50 is roughly cup-shaped within the cartridge, and contains a particulate obturating media 30. The particulate obturating media also extends beyond the length of the textile. The textile cup 50 does not extend to the top, crimped end of the hull. Accordingly, some horizontal cross-sectional slices would produce obturating media encircled by the textile within the cartridge walls, while more distal horizontal cross-sections would yield obturating media directly in contact with the cartridge walls. In other embodiments, the textile cup 50 could extend a lesser length or a greater length towards the crimp. A base wad of the types known in the art can be present as well, or can be built into the hull. The cartridge case would typically be crimped using any type of crimp known in the art.

Figure 5:
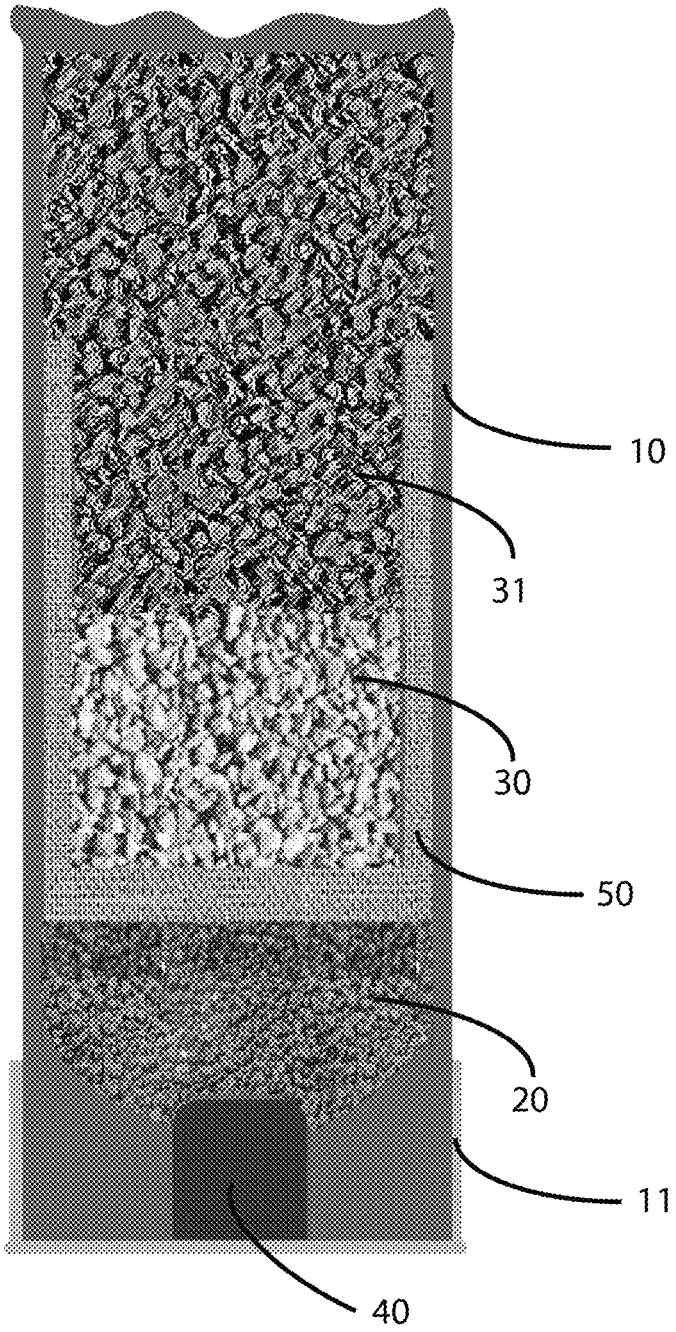
FIG. 5 shows a cutaway perspective view on one embodiment of a barrel-cleaning shotshell loaded with two types of particulate obturating media, and lacking a solid wad.

FIG. 5 is a schematic cutaway diagram showing a shotgun shell according to one embodiment of the disclosure as described herein. The cartridge case 10 (cutaway in the diagram to reveal the contents inside the casing), here shown to include a brass or metal-plated head 11 and primer 40, contains a powder charge or propellant 20, on top of which is a flexible textile 50. The flexible textile 50 is roughly cup-shaped within the cartridge, and contains a particulate obturating media 30. In this representative embodiment, the textile cup 50 does not extend to the top, crimped end of the hull. In other embodiments, the textile cup 50 could extend a lesser length or a greater length towards the crimp. In this embodiment, a second particulate obturating media 31 is partially contained within the textile cup, and extends beyond the top of the textile cup. A base wad of the types known in the art can be present as well, or can be built into the hull. The cartridge case would typically be crimped using any type of crimp known in the art.

Figure 6A:
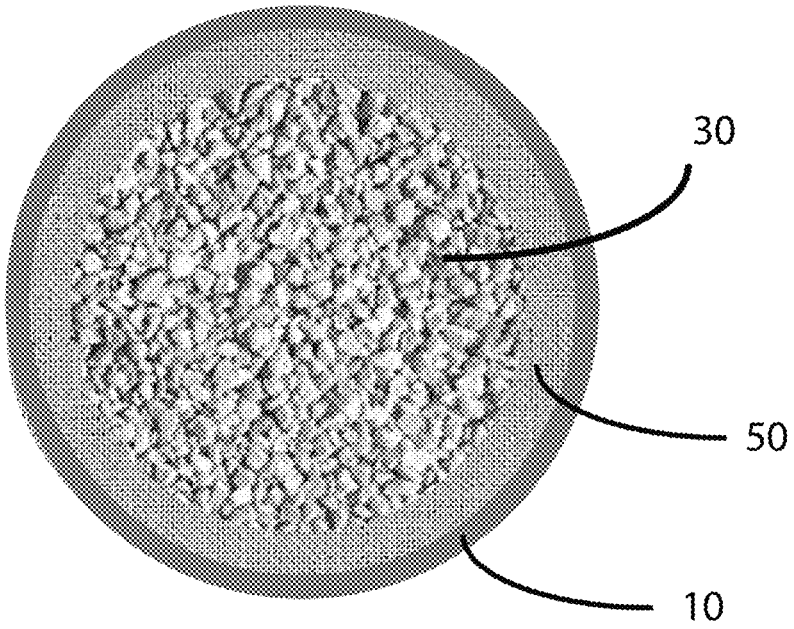
FIG. 6A is a schematic drawing showing a horizontal cross-sectional slice perpendicular to the long axis of the shotshell depicted in FIG. 5, wherein within the cross-sectional slice, particulate obturating media is fully encircled by a flexible textile.
Figure 6B:
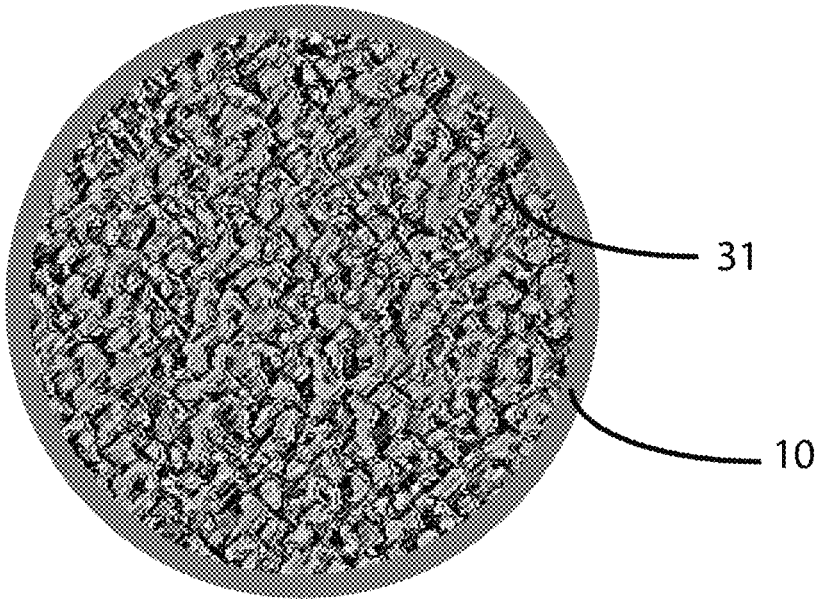
FIG. 6B is a schematic drawing showing a horizontal cross-sectional slice perpendicular to the long axis of the shotshell depicted in FIG. 5, wherein within the cross-sectional slice, particulate obturating media is not fully encircled by a flexible textile, and instead is in direct contact with the walls of the hull.

FIG. 6A is a horizontal cross-sectional slice (perpendicular to the long axis of the cartridge) of the barrel-cleaning shotshell cartridge depicted in FIG. 5. Inside the cartridge case 10, the flexible textile 50 completely encircles particulate obturating media 30. In some embodiments, additional particles of particulate obturating media can be compressed between the flexible textile 50 and the walls of the cartridge case 10, but some particulate media 30 would still be encircled by the flexible textile, thereby allowing it to push out against the textile when the cartridge is fired, forcing the textile to scrub the barrel. FIG. 6B is another horizontal cross-sectional slice (perpendicular to the long axis of the cartridge) of the barrel-cleaning shotshell cartridge depicted in FIG. 5, this one distal to the horizontal cross-sectional slice depicted in FIG. 6A. Inside the cartridge case 10, the particulate obturating media 31 directly contacts the walls of the cartridge. All embodiments of the invention require both representative types of cross-sectional slices in the same cartridge; i.e., at least one horizontal cross-sectional slice consistent with FIG. 6A, wherein particulate obturating media is completely encircled by the flexible textile, and at least one horizontal cross-sectional slice consistent with FIG. 6B, wherein the particulate obturating media is not encircled by the flexible textile, but instead particles of the particulate obturating media contact the walls of the hull (and ultimately the barrel) directly.

Note that FIGS. 1-6 are schematic drawings that do not depict all features or embodiments that are contemplated. For example, the amount of particulate obturating media can be more or less than is shown, as is the case with the propellant. Additional components may be added along with the obturating media, including solid or liquid components useful for cleaning the barrel. Other wads may be added, or projectiles such as steel or lead shot which facilitate cycling of autoloaders. The crimp may be sealed.

One feature of the present disclosure is the use of a particulate obturating media to provide or facilitate the gas sealing function typically provided by pre-formed wads as described above, whether as separate gas seals or as one-piece wads. Many wads made from biodegradable materials such as paper, cardboard, felt, fiber, or cork, have relatively poor gas sealing performance compared to conventional plastic wads. In contrast, the obturating media of the present disclosure provide outstanding gas seals when used according to the methods of the disclosure.

In all embodiments, the length (as measured from the most proximal particles to the most distal particles), as loaded, of the particulate obturating media, in any sized hull, is at least 8 mm, or 10 mm, or 15 mm, or 20 mm, or 25 mm. In other words, a sufficient amount of obturating medium must be added such that it fills up at least 8 mm of the length of a cartridge, noting that cartridges are typically cylindrical or tapered cylindrical in shape. This can also be phrased as a sufficient amount of obturating media must be added such that it fills up at least 8 mm of the linear volume of the cartridge. More technically, a sufficient volume of particulate obturating media is added to fill a percentage of the cartridge equal to 8 mm divided by the interior length of the loaded cartridge when subjected to the pressure of a loaded cartridge. In some embodiments, a sufficient volume of obturating media is added to occupy a volume equal to the product of 8 mm and the average cross-dimensional area of the hull, or the product of 10 mm and the average cross-dimensional area of the hull, or greater volumes. If the amount of obturating media in the cartridge is an amount insufficient to occupy at least 8 mm of the length of the loaded and crimped cartridge, then the obturating media will not itself provide the desired dual functions of substantial gas sealing and barrel scouring.

Moreover, as the last component of the cartridge to leave the barrel is the propellant, it is important to get a clean burn of the propellant, which requires resistance against expansion, meaning sufficient weight of particulate obturating media is required. In all embodiments for a 12 gauge shotshell, at least 0.25 ounces of total particulate obturating media is used, irrespective of the cartridge length. For other gauge shotshells, minimum weight requirements scale proportionately with the cross-sectional area of the cartridge. For example, the minimum weight of particulate obturating media for a 20 gauge shotshell would be roughly 71% of the minimum weight of particulate obturating media for a 12 gauge shotshell.

The methods and articles of the disclosure require that the particulate obturating media comprises particles that have the form of a granular solid (including a granular powder). If the average particle size is too small, then the ease of loading is diminished, particularly for automated loading machines, and chamber pressures may be too high upon firing. Smaller particles tend to have a higher ratio of surface area to volume, and are relatively more susceptible to absorbing moisture, which can impede flow. Caking can occur, dispensing volumes can be erratic, and dust can be messy and hazardous to health. Moreover, after firing a shotgun loaded with a cartridge comprising a particulate obturating media with average particle size less than 212 microns, the smaller particles (i.e., less than 212 micron) are more likely to annoy a shooter by blowing back into the shooter's face. Accordingly, as described herein, the obturating media preferably comprises particles having an average size exceeding 212 microns. In some preferred embodiments, the obturating media has an average size exceeding 250 μm, or 300 μm, or 400 μm, or 500 μm, or 600 μm, or 700 μm, or 800 μm, or 840 μm, or 900 μm, or 1,000 μm, or 1,100 μm, or 1,200 μm, or 1,250 μm, or 1,300 μm, or 1,400 μm, or 1,500 μm, or 1,600 μm.

In some embodiments, at least 85%, or 90%, or 95%, or 97% by weight of the obturating media passes through a U.S. mesh size 10 filter, and is retained on a U.S. mesh size 60 filter. In some embodiments, at least 85%, or 90%, or 95%, or 97% by weight of the obturating media passes through a U.S. mesh size 12 filter, and is retained on a U.S. mesh size 50 filter, or U.S. mesh size 40 filter, or U.S. mesh size 36 filter, or U.S. mesh size 30 filter, or U.S. mesh size 24 filter, or U.S. mesh size 20 filter. In some embodiments, at least 85%, or 90%, or 95%, or 97% by weight of the obturating media passes through a U.S. mesh size 14 filter, and is retained on a U.S. mesh size 50 filter, or U.S. mesh size 40 filter, or U.S. mesh size 36 filter, or U.S. mesh size 30 filter, or U.S. mesh size 24 filter, or U.S. mesh size 20 filter, or U.S. mesh size 16 filter.

Any methods known in the art can be used to produce the obturating media, or granular components thereof. For example, a biodegradable polymer formulation can be produced using an extruder, and the resulting nurdles can be subjected to grinding to produce particles comprising biodegradable polymer formulations suitable for use in the obturating media, e.g., having the appropriate size, density, and shape. Alternatively, for example, a biodegradable polymer can be produced as a powder, and even used unpurified, alone or in conjunction with other components.

Natural materials can be ground or shredded. For example, nut shells such as pecan or walnut can be ground, as can pitted fruits such as apricots. Corn cob hulls can be ground to produce particles suitable for use as a particulate obturating media.

Glass beads can be made using methods known in the art.

Soft metal particles can be cast, made from cut wire, or made using methods known in the art.

Other compounds can be used as they naturally occur, and simply sorted by size.

The obturating media can be limited to just one type of particles, or multiple types of particles. Additives such as flow control agents, anti-static agents, pigments or other colorants, degradation enhancers, natural polymers, polysaccharides, stabilizers, plasticizers, desiccants, antimicrobial agents, scent agents, or other additives can be included.

The average specific gravity of the particles in the obturating media should exceed 1.1. As used herein, the term "average specific gravity" refers to a weighted average of the specific gravity of the particles in the obturating media. An average specific gravity greater than 1.1 is not a necessary characteristic of obturating media in order to provide a supplementary gas seal, but it is important in order to have a commercially appealing product. An obturating media with less dense particles is generally more difficult to load (worse particle flow). Moreover, given that these barrel-cleaning loads typically lack dense shot that provides added weight, it is important for the obturating media to be heavy enough to provide sufficient resistance against the powder needed for a clean burn. Moreover, particles greater than 212 microns in size and having a specific gravity greater than 1.1, when fired from the barrel at the high speeds of typical shotgun loads, are unlikely to blow back into a shooter's face after a shot is fired. Generally speaking, particles that are larger and denser tend to deviate less quickly from the initial flight path than smaller, less dense particles that are otherwise equivalent. The specific gravity of the particles comprising the obturating media can be greater than 1.1, greater than 1.2, greater than 1.3, greater than 1.4, greater than 1.5, greater than 1.6, greater than 1.7, greater than 1.8, greater than 1.9, greater than 2.0, or greater than 2.5.

Suitable particles that can serve as the basis for the obturating media can comprise any particle formulations that meet the above-listed characteristics regarding particle size and specific gravity.

In some embodiments, the obturating media comprises particles comprising polymers.

In some embodiments, the particles of the obturating media comprise a biodegradable thermoplastic polymer.

In some embodiments, the obturating media comprises particles comprising polymers. In some embodiments, the particles of the obturating media themselves comprise multiple polymers. In particular, they can comprise multiple polymers of plant origin, typically naturally occurring material. For example, the particles of the obturating media can comprise a mixture of: lignin, one or more hemicelluloses, and cellulose. In other embodiments, the biodegradable polymer comprises a protein, including for example zein, collagen, silk, and/or keratin. In other embodiments, the biodegradable polymer comprises a polysaccharide such as a cellulosic polymer, an alginate, and/or a starch. Cellulosics include plant materials such as ground coffee beans, jute, hemp, and/or cotton, which often include other polymers.

In some embodiments, the obturating media comprises particles from plant matter including but not limited to nut shells (for example, pecan shells, walnut shells), fruit pits (e.g., cherry pits, apricot pits), corn cob hulls, and rice hulls. In some embodiments, the obturating media comprises combinations of particles from different plant matter.

Walnut shell particles can be particularly suitable as a component of obturating media. Various species of walnut shells can be useful, including black walnut (*Juglans nigra*) and European walnut, although they have different characteristics. Black walnut has a tremendously high modulus of elasticity. It does not easily fracture or create dust at ordinary pressures, which is important as large-scale automated shotshell loading could require huge amounts of obturating media. Dust can be toxic, and consistency from load to load is improved if the particles resist fracturing during transport and storage in, for example, a 2,000 pound supersack. Walnut also is somewhat resistant to microbial decay, meaning that microbial attack and decay is less likely than for some other organic obturating media. This is particularly important as shotshells are not always stored in pristine environments, and are rarely sealed against the elements. Introduction of mold, for example, into a shotshell loaded with obturating medium could quickly change the characteristics of the obturating medium and impair the performance of the shotshell. Walnut shell is harder than many organic materials, with a Mohs hardness of approximately 4, but generally will not scratch shotgun barrels. Walnut shell media is also a waste product that is inexpensive and readily available. Walnut shell particles also do not tend to absorb as much water from the air as similarly sized particles from other plant species. Walnut shell particles also have excellent flowability parameters, and thus are easy to meter and load, even in smaller particle sizes.

Corn cob hull media also has many positive attributes for use in obturating media. Relative to walnut shell particles, particles of corn cob hulls tend to absorb more water and are more prone to rotting, both of which can be disadvantages. Anti-microbial agents or preservatives (e.g., citric acid, borax) can be incorporated into the particles or obturating media or cartridge to reduce the sensitivity of corn cob hull obturating media (or any other particulate obturating media) to microbial attack. Corn cob media also has advantages. It has a lower bulk density and is more compressible, for example, than walnut shell media. The reduced bulk density lowers the weight of the ejecta, and the enhanced compressibility provides for more forgiveness and tolerance during loading and storage of loaded cartridges. Corn cob media also helps prevent migration of smaller particles, for example glass beads. In some embodiments, corn cob media is added on top of glass beads to reduce the likelihood of gas beads flowing out of poorly sealed crimps.

Particles comprising primarily inorganic chemicals can be used as obturating media. In some embodiments, particles containing substantial fractions of both organic and inorganic compounds are used. Many inorganic compounds can be successfully employed as obturating media in accordance with the methods and devices described herein. Many inorganic compounds can be overly hard (harder than 6.5 on a Mohs scale), causing concerns about barrel scratching and making it more difficult to obtain a good gas seal unless very small particles are used. For example, aluminum oxide has a Mohs hardness of approximately 9. Glass beads or crushed glass, as well as sand, can be used. Glass beads, in particular, are advantageous in their ability to provide a polishing effect to the barrel. Calcium carbonate particles can be an effective inorganic obturating medium. Other minerals, including gypsum and talc, can also be used. Naturally occurring shell matter, including from eggshells, oyster shells, or other shells, can provide a suitable obturating media.

While many metals and metal oxides are too hard to be used, there are metal particles that can be used as obturating media. For example, zinc particulate obturating media is a good choice, as it is both dense and soft (4 on the Mohs scale). Zinc particles are used as blast media, and do not aggressively damage surfaces. Since zinc has a density of roughly 7 g/cm$^3$, zinc particulate obturating media used for barrel cleaning loads should be small particles, less than 1,000 microns on average, and preferably less than 550 microns, in order to reduce potential injury if the barrel cleaning load is fired in the direction of a person or animal. Generally speaking, particles with a density greater than 4 g/cm$^3$ should average less than 1,000 microns in size when used in this application.

A significant advantage of some obturating media compared with others is a reduced tendency to absorb water from the air, thereby providing greater performance consistency over time. Particles that absorb substantial quantities of water can increase mass and volume within the hull, which can impact pressure upon firing. In some embodiments, the water absorption of the obturating media is less than 1% at 23° C., as measured by ASTM D570-Standard Test Method for Water Absorption of Plastics. In some embodiments, the water absorption of the obturating media is less than 2%, or 3%, or 4%, or 5%, at 23° C., as measured by ASTM D570-Standard Test Method for Water Absorption of Plastics.

It is important that the particles used in the obturating media do not remain as persistent organic pollutants after being fired. When thermoplastic polymers are used in the obturating media, it is important that these polymeric particles biodegrade. Suitable biodegradable polymer formulations can comply with one or more definitions of biodegradable. The ASTM D6400 is entitled Standard Specification for Labeling of Plastics Designed to be Aerobically Composted in Municipal or Industrial Facilities. See ASTM Standard D6400, 2004, "Standard Specification for Compostable Plastics," ASTM International, West Conshohocken, Pa., 2004, DOI: 10.1520/D6400-04, www.astm.org, wherein the ASTM Standard D6400, 2004 is incorporated by reference in its entirety. The ASTM D6400 identifies three governing provisions that must be met: the product must physically degrade such that the product is not "readily distinguishable" from the surrounding compost, the product must be consumed by microorganisms at a rate comparable to other known compostable materials, and the product cannot adversely impact the ability of the compost to support plants. This specification covers plastics and products made from plastics that are designed to be composted in municipal and industrial aerobic composting facilities.

As used herein, a "biodegradable" formulation means a formulation that satisfies ASTM D6400 (any version thereof, including ASTM D6400-04), ASTM D6868, or EN 13432. In some embodiments, a material is biodegradable if it undergoes degradation by biological processes during composting to yield $CO_2$, water, inorganic compounds, and biomass at a rate consistent with other known compostable materials. Degradation can be defined by a deleterious change in the chemical structure, physical properties, or appearance of the material. See ASTM D6400, 2004. A biodegradable material can be defined by the ability to completely break down and return to nature, i.e., decompose into elements found in nature within a reasonably short period of time such as one year after customary disposal. A biodegradable material can be defined as a material wherein all the organic carbon can be converted into biomass, water, carbon dioxide, and/or methane via the action of naturally occurring microorganisms such as bacteria and fungi, in timeframes consistent with the ambient conditions of the disposal method. See ASTM D883.

The obturating media described herein, when comprising primarily organic polymers, comprises particles comprising a biodegradable polymer formulation, wherein the content of the biodegradable polymer in said biodegradable polymer formulations comprises by weight at least 10% of the total weight of the biodegradable polymer formulation, or at least 20%, at least 30%, at least 40%, at least 50%, at least 60%, at least 70%, at least 80%, at least 90%, or at least 95%, or ranges incorporating any of the foregoing values. More than one biodegradable polymer can be used in such biodegradable polymer formulations.

In some embodiments of the invention, plant materials are used, typically plant materials that occur naturally; for example, granulated nut shells, rice hulls, or corn cobs. These plant materials typically are cellulosic in nature, and often include a combination of the polymers cellulose, lignins, and hemicelluloses.

Lignins (also referred to as the singular lignin) are a class of complex phenolic polymers, and are the second most abundant organic polymers on earth, exceeded only by cellulose. The composition of lignin varies from species to species.

Hemicelluloses are polysaccharides that typically co-present with cellulose, although they are structurally different. Cellulose consists entirely of linked glucose units, whereas hemicelluloses can include a number of other sugars besides glucose, including for example the five-carbon sugars xylose and arabinose and the six-carbon sugars mannose and galactose. Hemicelluloses can also contain acidified sugars such as glucuronic acid and galacturonic acid.

The specific ratio of cellulose to lignin to hemicelluloses varies across species and across components of the same plant. In typical embodiments, when obturating media comprises particles from plant matter, the particles comprise at least 10% by weight of each of cellulose, lignin, and hemicellulose.

When non-biodegradable, inorganic particulate obturating media is used, it is important that said obturating media is relatively non-toxic. For example, tiny lead particles that might function as particulate obturating media are unacceptable to use because of their toxicity.

The methods and cartridges described herein are useful for cleaning the barrels of firearms, and are also suitable for use as blanks. For example, a hunter might conclude a day of hunting by firing a cartridge useful for cleaning the barrel of a gun to remove residue on the barrel that builds up as shots are fired.

When a large fraction of the cartridge comprises particulate obturating media, then during the loading process, the obturating media is typically added in multiple doses, with some mechanical means for removing trapped air (e.g., by shaking, agitation, compression, pressure) in between successive additions of the granular obturating media. When a smaller fraction of the cartridge comprises obturating media, then it is more amendable to being added in a single dose.

In some embodiments, to a primed hull is added successively powder, a solid wad, a flexible textile, and one or more types of obturating media. In some embodiments, the flexible textile is pushed into the hall through an open tube, through which obturating media is added. The open tube is then withdrawn, and additional components (including obturating media) can be added as needed. The components are typically then compressed, commonly via a rod inserted into the cartridge with insufficient pressure to cause the cartridge to bulge, but with sufficient pressure to help compress and settle the contents and remove air. The cartridge is then crimped shut.

For example, in one embodiment, to a primed hull is successively added propellant, obturating media, a solid wad, a flexible textile, and a second particulate obturating media. The hull is then crimped, optionally sealed, and eventually loaded and fired to clean the barrel of a firearm.

In another embodiment, to a primed hull is successively added propellant, a flexible textile, a solid wad, and three types of particulate obturating media. The hull is then star-crimped.

In another embodiment, to a primed hull is successively added a single base powder propellant, a fiber wad, a slightly elastic rayon nonwoven textile, 0.25 oz. glass beads with an average size of around 500 microns, and 0.05 oz. 20/40 mesh corn cob media, which helps prevent migration of the glass beads which flow very well.

In another embodiment, to a primed hull is successively added a single base powder propellant, a fiber wad, a flexible textile, 0.6 oz cast zinc particulate obturating media having an average size of 500 microns, 0.1 oz. glass beads with an average size of around 500 microns, and 0.05 oz. 20/40 mesh corn cob media.

Figure 7:
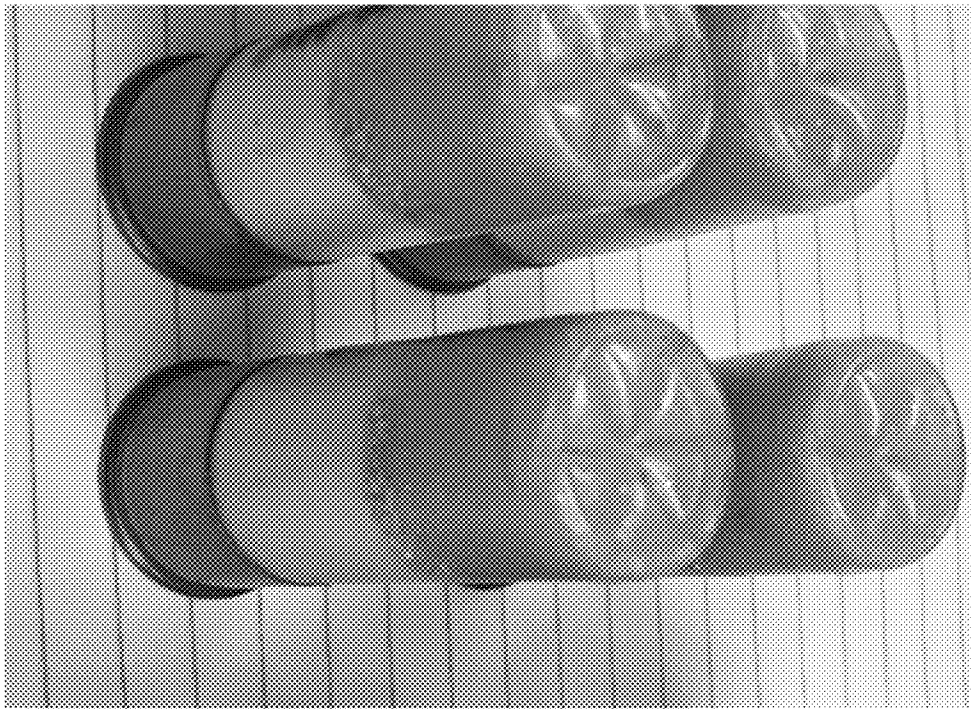
FIG. 7 is a photographic image of several cartridges useful for cleaning the barrel of a shotgun as described herein.

In another embodiment, to a primed hull is added a smokeless powder propellant, a flexible textile, a fiber wad, zinc particulate obturating media, and glass beads, followed by crimping. Loaded cartridges of this type are shown in FIG. 7.

In another embodiment, to a primed hull is added a smokeless powder propellant, a multi-petaled flexible textile having a basis weight of 6 osy and extending roughly 1 inch along the hull from its most proximal point to its most distal point, 70 grains of 12/20 mesh walnut shell obturating media, and sufficient corn cob media to fill the hull, followed by crimping.

In another embodiment, to a primed hull is added a smokeless powder propellant, a flexible textile, walnut shell obturating media, glass bead media, and corn cob media, followed by crimping.

In another embodiment, to a primed 12 gauge hull is added a smokeless powder propellant, a multi-petaled flexible textile having a basis weight of 10 osy and extending roughly 3 cm along the hull from its most proximal point to its most distal point within the hull, 100 grains of 12/20 mesh walnut shell obturating media, and sufficient 500 micron average zinc particulate media to fill the hull, followed by crimping.

In another embodiment, to a primed 12 gauge hull is added between 15 and 20 grains of a single base propellant followed by a flexible nonwoven textile with modest elasticity. An open tube is used to push the textile into the hull, where it assumes a general cup shape that extends (averaged across the 360 degrees of the hull) about one inch on average along the walls of the hull. Obturating media is added through the open tube, followed by a compression step with a closed rod. Additional types of obturating media can be added to fill up the cartridge before crimping.

In some embodiments, the obturating medium is used in factory loading conditions to produce cartridges as described herein. In other embodiments, the obturating medium is used for hand-loading to produce cartridges as described herein.

Cartridges as described herein can be designed and fabricated to be used in any firearm including but not limited to pistols, shotguns, and rifles.

EXAMPLES

Polymer resins can be obtained from numerous suppliers. For example, PHA can be obtained from Danimer Scientific in Bainbridge, Ga.; PLA can be obtained from NatureWorks in Minnetonka, Minn.; and PCL can be obtained from Perstorp in Warrington, England. Polymer resins can also be obtained from other suppliers. Polymers of other types can be obtained from many sources, including as waste products. There are many commercial sources of walnut shell media, corn cob media, granulated oyster shells, calcium carbonate, zinc media, and other obturating media described herein.

Figure 8A:
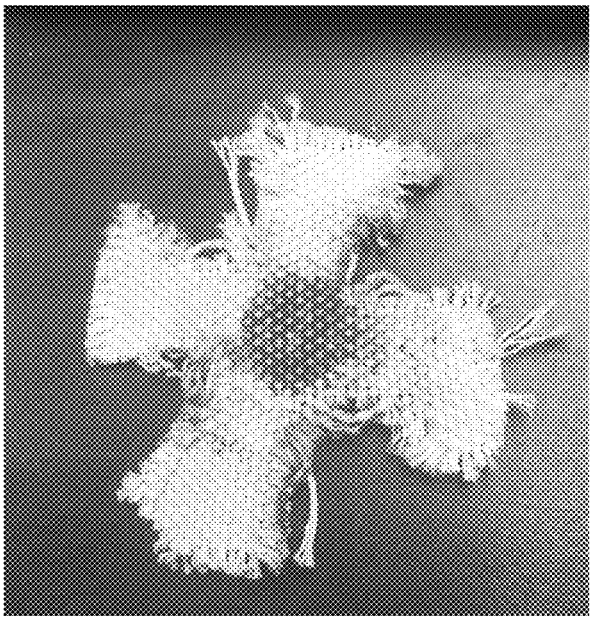
FIG. 8A is a photographic image of one side of a flexible textile of a barrel-cleaning cartridge that was recovered after the cartridge was fired to clean the barrel.
Figure 8B:
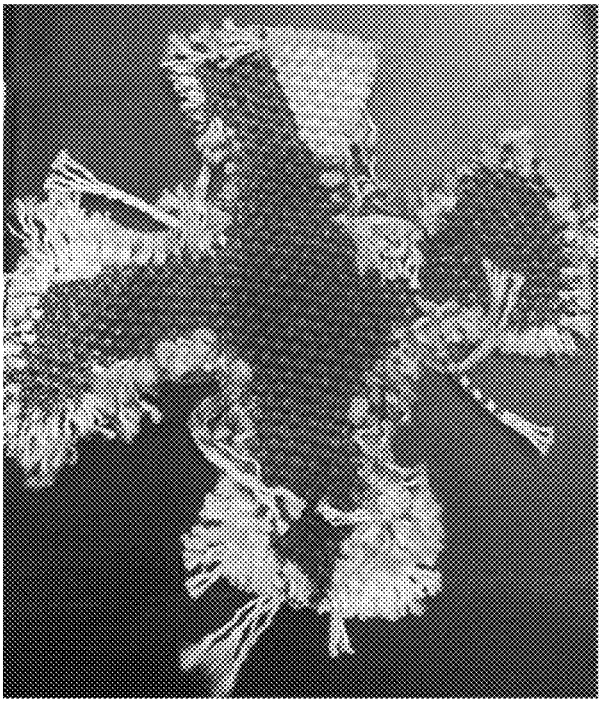
FIG. 8B is a photographic image of the other (exterior) side of a flexible textile shown in FIG. 8A.

Example 1. A primed, 2.75 inch, 12 gauge Fiocchi hull was loaded with a smokeless shotshell powder, and then a 4-petaled, 24 ounce per square yard canvas textile (measuring 2.7 inches from petal tip to petal tip) wrapped around a fiber wad (16 gauge, 0.5 inches in length) was inserted on top of the powder, thereby forming a flexible textile cup within the cartridge. A granular formulation of 12/20 walnut media comprising primarily particles between 841 microns and 1,680 microns in size was added into the textile cup as an obturating media. A second obturating media comprising glass beads (20-30 grit) was added on top of the walnut media. The cartridge was star-crimped and loaded into a shotgun after the shotgun had been used at a shooting range. The barrel-cleaning shell was fired, and the textile was recovered. Photographs of the front and back sides of the recovered textile are shown in FIG. 8A and FIG. 8B. The side that formed the interior of the textile cup is shown in FIG. 8A, and the side that provided the exterior of the textile cup (i.e., the side that rubbed against the interior of the barrel) is shown in FIG. 8B. As is apparent in FIG. 8B, a substantial amount of residue was cleaned from the barrel by the textile cup. Additional residue is removed by elements of the obturating media.

Figure 9:
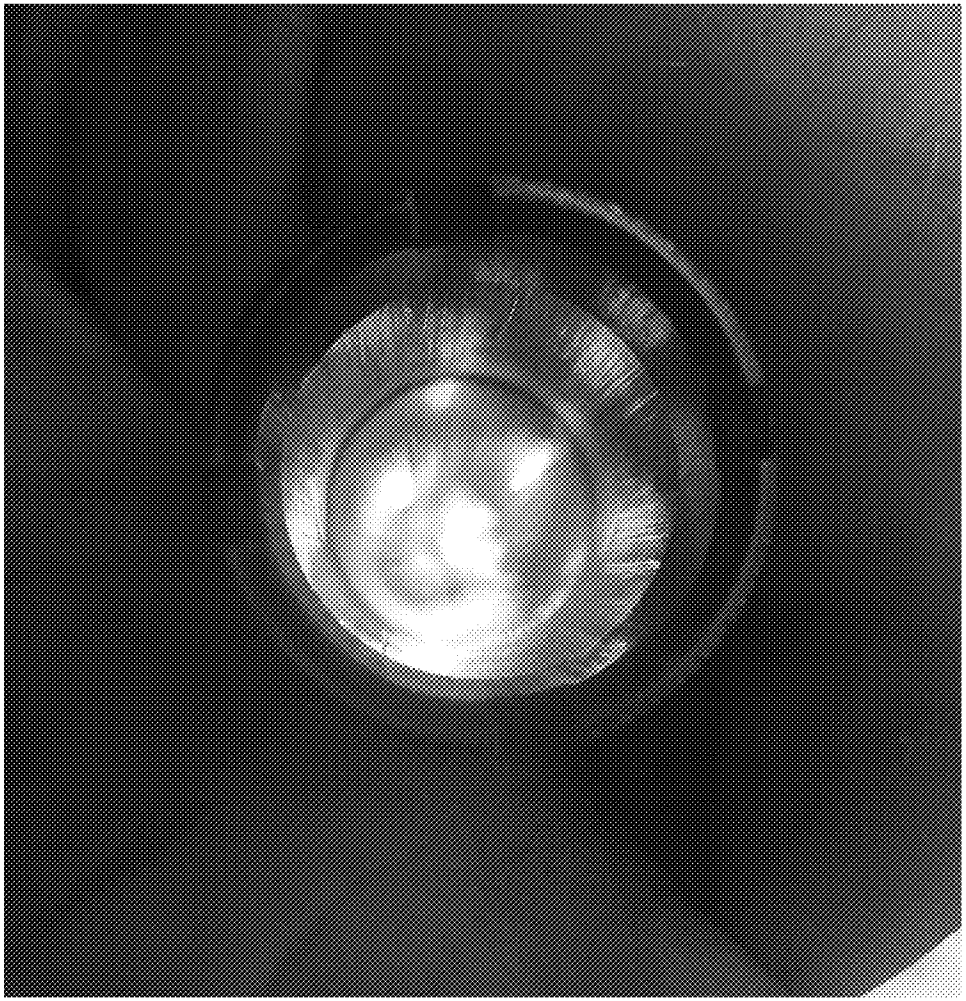
FIG. 9 is a photographic image of a clean shotgun barrel taken after shooting a barrel-cleaning cartridge as described herein.

Example 2. A primed, 2.75 inch, 12 gauge Fiocchi hull was loaded with a smokeless shotshell powder, a nitro card, a multi-petaled, 8 ounce per square yard, needlepunched, viscose rayon nonwoven textile, and then glass beads were added to fill the hull, which was star-crimped. The cartridge was loaded into a shotgun after the shotgun had been used at a shooting range and subsequently fired. FIG. 9 is an original (not touched up) photographic image of the barrel of the shotgun after the barrel-cleaning cartridge described above was fired from the shotgun. Note the lack of lead buildup or particulate matter on the barrel.

Example 3. A series of primed, 2.75 inch, 12 gauge Fiocchi hulls were successively loaded with 18 grains of a single base smokeless powder, a multi-petaled, 8 ounce per square yard, needlepunched, viscose rayon nonwoven textile, then filled with 12/20 mesh walnut media and star-crimped. The cartridges were loaded into a shotgun and fired. Barrel pressures averaged roughly 10,000 psi, clean powder burns were achieved, and the hulls did not tear. The textiles tore upon shooting, often into multiple fragments.

INCORPORATION BY REFERENCE

All publications, patents, and patent applications cited herein are hereby expressly incorporated by reference in their entirety and for all purposes to the same extent as if each was so individually denoted.

EQUIVALENTS

While specific embodiments of the subject invention have been discussed, the above specification is illustrative and not restrictive. Many variations of the invention will become apparent to those skilled in the art upon review of this specification. The full scope of the invention should be determined by reference to the claims, along with their full scope of equivalents, and the specification, along with such variations.

The articles "a" and "an" are used herein to refer to one or to more than one (i.e. to at least one) of the grammatical object of the article. By way of example, "a wad" means one wad or more than one wad.

Any ranges cited herein are inclusive.

What is claimed is:

1. A firearm barrel-cleaning cartridge comprising:

a) a cartridge case having a proximal end and a distal end and comprising a primer situated at the proximal end;

b) a propellant, a portion of which is contiguous with the primer;

c) a flexible textile; and d) at least one type of non-metallic particulate obturating media;

wherein at least some portion of said non-metallic particulate obturating media is distal to the propellant and textile;

wherein said non-metallic particulate obturating media comprises discrete particles not physically bound to each other;

wherein said particles of said non-metallic particulate obturating media have an average specific gravity of greater than 1.1;

wherein said particles of said non-metallic particulate obturating media have an average size greater than 212 microns;

wherein said textile has a basis weight between about 4 ounces per square yard and 30 ounces per square yard;

wherein said textile extends a length within the cartridge of at least 8 mm from the most proximal point of the textile to the most distal point of the textile;

wherein at least one cross-sectional slice perpendicular to the long axis of the cartridge yields a portion of said non-metallic particulate obturating media which is completely encircled by said flexible textile; and wherein said non-metallic particulate obturating media has a hardness below 7 on the Mohs scale.

2. The cartridge of claim 1, wherein said particulate obturating media occupies at least 8 mm in length within the cartridge case.

3. The cartridge of claim 1, wherein said propellant is a single base smokeless powder.

4. The cartridge of claim 1, wherein said textile is a biodegradable textile comprising fibers that biodegrade in accordance with ASTM D6400.

5. The cartridge of claim 1, wherein particles of the particulate obturating media which have a density exceeding 4 g/cm$^3$ also have an average size of less than 1000 microns.

6. The cartridge of claim 1, comprising at least two different types of particulate obturating media.

7. The cartridge of claim 1, wherein said particulate obturating media comprises glass beads.

8. The cartridge of claim 1, wherein said particulate obturating media extends at least one centimeter beyond the distal-most portions of the textile within said hull.

9. The cartridge of claim 1, wherein said textile, when subjected to the cantilever test option of ASTM D-1388 (a standard test method for stiffness of fabrics), has an average overhang length of five inches or less.

10. The cartridge of claim 1, wherein said particulate obturating media comprises a lignin-containing plant material selected from the group consisting of corn cobs and walnut shells.

11. The cartridge of claim 1, wherein at least 90% by weight of said particles are retained on a 300 micron filter.

12. The cartridge of claim 1, wherein said cartridge is configured to be fired from a pistol to clean the barrel of a pistol.

13. The cartridge of claim 12, wherein said cartridge additionally comprises zinc particles.

14. The cartridge of claim 1, further comprising a solid wad.

15. The cartridge of claim 14, wherein said solid wad is adjacent to and immediately distal to the propellant.

16. The cartridge of claim 14, wherein said solid wad is situated inside of said textile, wherein said textile assumes the general shape of a cup, and wherein the most proximal part of the textile is in closer proximity to the propellant than is the solid wad.

17. The cartridge of claim 1, wherein said cartridge is configured to be fired from a shotgun to clean the barrel a shotgun.

18. The cartridge of claim 1, wherein said textile assumes the general shape of a cup, and wherein at least 5 mm in length of said particulate obturating media is contained within said general shape of a cup.

19. A method for cleaning the barrel of a firearm, comprising the steps of:

a) loading a barrel-cleaning cartridge into a firearm;

b) firing said firearm;

wherein said barrel-cleaning cartridge comprises: a cartridge case having a proximal end and a distal end and comprising a primer situated at the proximal end; a propellant, a portion of which is contiguous with the primer; a flexible textile; and a non-metallic particulate obturating media;

wherein at least some portion of said non-metallic particulate obturating media is distal to the propellant and textile;

wherein said non-metallic particulate obturating media comprises discrete particles not physically bound to each other;

wherein said particles have an average specific gravity of greater than 1.1;

wherein said particles have an average size greater than 212 microns and less than 1,680 microns;

wherein said textile has a basis weight between about 4 ounces per square yard and 30 ounces per square yard;

wherein said textile extends a length within the cartridge of at least 8 mm from the most proximal point of the textile to the most distal point of the textile;

wherein at least one cross-sectional slice perpendicular to the long axis of the cartridge yields a portion of said non-metallic particulate obturating media completely encircled by said flexible textile; and wherein said non-metallic particulate obturating media has a hardness below 7 on the Mohs scale.

* * * * *